US010858877B2

(12) United States Patent
Hatzky

(10) Patent No.: US 10,858,877 B2
(45) Date of Patent: Dec. 8, 2020

(54) INSULATING STRIP FOR DOOR, WINDOW OR FAÇADE ELEMENTS, COMPOSITE PROFILE FOR DOOR, WINDOW OR FAÇADE ELEMENTS, AND METHOD FOR FINISHING MANUFACTURING OF A ROLL-IN HEAD OF AN INSULATING STRIP FOR DOOR, WINDOW OR FAÇADE ELEMENTS

(71) Applicant: TECHNOFORM BAUTEC HOLDING GMBH, Kassel (DE)

(72) Inventor: Marcel Hatzky, Lohfelden (DE)

(73) Assignee: TECHNOFORM BAUTEC HOLDING GMBH, Kassel (DE)

( * ) Notice: Subject to any disclaimer, the term of this patent is extended or adjusted under 35 U.S.C. 154(b) by 1 day.

(21) Appl. No.: 16/096,464

(22) PCT Filed: Apr. 25, 2017

(86) PCT No.: PCT/EP2017/059806
§ 371 (c)(1),
(2) Date: Oct. 25, 2018

(87) PCT Pub. No.: WO2017/186722
PCT Pub. Date: Nov. 2, 2017

(65) Prior Publication Data

US 2019/0119973 A1 Apr. 25, 2019

(30) Foreign Application Priority Data

Apr. 26, 2016 (EP) ..... 16167098

(51) Int. Cl.
*E06B 3/263* (2006.01)
*E06B 3/273* (2006.01)

(52) U.S. Cl.
CPC ..... *E06B 3/26303* (2013.01); *E06B 3/26305* (2013.01); *E06B 3/273* (2013.01);
(Continued)

(58) Field of Classification Search
CPC .. E06B 3/26305; E06B 3/26303; E06B 3/273; E06B 2003/26314;
(Continued)

(56) References Cited

U.S. PATENT DOCUMENTS 3,093,217 A 6/1963 Doede
4,096,678 A * 6/1978 Diels ..... B23P 11/00 52/396.05

(Continued)

FOREIGN PATENT DOCUMENTS

CH 354573 A 5/1961
DE 2552700 B1 6/1977

(Continued)

OTHER PUBLICATIONS

International Search Report dated Aug. 23, 2017 for parent application No. PCT/EP2017/059806.

(Continued)

*Primary Examiner* — Christine T Cajilig
(74) *Attorney, Agent, or Firm* — J-Tek Law PLLC; Jeffrey D. Tekanic; Scott T. Wakeman

(57) ABSTRACT

An insulating strip (3) connects profiles (2) of a composite profile (1) for doors, windows or façade elements. At least one of the profiles has a roll-in groove (6) and is composed of a first metal material. The insulating strip (3) includes a strip body (4) composed of an insulating material and extending in a longitudinal direction (z). A roll-in head (5) is formed at a longitudinal edge of the strip body (4). The roll-in head (5) has a cross-sectional shape in a plane (x-y) perpendicular to the longitudinal direction (z) suitable for
(Continued)

insertion into the roll-in groove (6). A metal sheet (13) having surface variations (17; 18) covers at least a portion of a surface (10, 11, 12) of the roll-in head (5). At least a portion of the sheet (13) is composed of a second metal material having a tensile strength of 300 N/mm$^2$ or more.

26 Claims, 6 Drawing Sheets

(52) U.S. Cl.
CPC ..... *E06B 2003/2635* (2013.01); *E06B 2003/26314* (2013.01); *E06B 2003/26372* (2013.01); *E06B 2003/26374* (2013.01); *E06B 2003/26396* (2013.01)

(58) Field of Classification Search
CPC ... E06B 2003/2635; E06B 2003/26372; E06B 2003/26374; E06B 2003/26396
See application file for complete search history.

(56) References Cited

U.S. PATENT DOCUMENTS

| | | | |
|---|---|---|---|
| 4,194,284 | A | 3/1980 | Diels et al. |
| 4,213,236 | A | 7/1980 | Diels et al. |
| 4,395,862 | A | 8/1983 | Jager et al. |
| 5,117,601 | A | 6/1992 | Habicht |
| 2009/0229202 | A1 | 9/2009 | Dampierre |

FOREIGN PATENT DOCUMENTS

| | | | | | |
|---|---|---|---|---|---|
| DE | 2830798 | A1 | | 1/1980 | |
| DE | 2937454 | A1 | | 4/1981 | |
| DE | 3203631 | A1 | | 8/1983 | |
| DE | 3203631 | A1 | * | 8/1983 | |
| DE | 3236357 | A1 | | 4/1984 | |
| DE | 3407121 | A1 | * | 9/1985 | |
| DE | 3407121 | A1 | | 9/1985 | |
| DE | 2745166 | C2 | | 9/1986 | |
| DE | 3633933 | A1 | | 4/1988 | |
| DE | 3633932 | C1 | | 5/1988 | |
| DE | 3742416 | A1 | | 6/1989 | |
| DE | 3939968 | A1 | | 6/1991 | |
| DE | 29607003 | U1 | * | 8/1996 | ..... E06B 3/308 |
| DE | 102004038868 | A1 | * | 2/2006 | ..... E06B 3/26303 |
| DE | 102015007611 | A | * | 12/2016 | ..... E06B 3/26301 |
| EP | 0032408 | A2 | | 7/1981 | |
| EP | 0085410 | A2 | | 8/1983 | |
| EP | 0032408 | B1 | | 1/1984 | |
| EP | 0085410 | B1 | | 4/1987 | |
| EP | 0137764 | B1 | | 9/1987 | |
| EP | 2045430 | A2 | | 4/2009 | |
| EP | 2476853 | A1 | * | 7/2012 | ..... E06B 3/273 |
| EP | 2559838 | A2 | * | 2/2013 | ..... E06B 3/26303 |
| EP | 3156579 | A1 | * | 4/2017 | ..... E06B 3/26301 |
| GB | 1523676 | A | | 9/1978 | |
| GB | 2058893 | A | * | 4/1981 | |
| WO | 8403326 | A1 | | 8/1984 | |

OTHER PUBLICATIONS

Written Opinion dated Aug. 23, 2017 for parent application No. PCT/EP2017/059806.
Wikipedia entry—"Aluminium" —https://de.wikipedia.org/wiki/Aluminium.
Wikipedia entry—"Polyamide" —https://de.wikipedia.org/wiki/Polyamide.
Wikipedia entry—"Rostfreier Stahl" —https://demikipedia.org/wiki/Rostfreier_Stahl.
Communication of a notice of opposition from the European Patent Office dated Mar. 17, 2020 against counterpart EP Patent No. 3 303 748 B1, including Grounds for Opposition (in German), the counterpart European Patent No. 3 303 748 B1 and an English translation of the Grounds for Opposition.

* cited by examiner

INSULATING STRIP FOR DOOR, WINDOW OR FAÇADE ELEMENTS, COMPOSITE PROFILE FOR DOOR, WINDOW OR FAÇADE ELEMENTS, AND METHOD FOR FINISHING MANUFACTURING OF A ROLL-IN HEAD OF AN INSULATING STRIP FOR DOOR, WINDOW OR FAÇADE ELEMENTS

CROSS-REFERENCE

This application is the U.S. National Stage of International Application No. PCT/EP2017/059806 filed on Apr. 25, 2017, which claims priority to European patent application no. 16 167 098.9 filed on Apr. 26, 2016.

TECHNICAL FIELD

The present invention relates to an insulating strip for door, window or façade elements, a composite profile for door, window or façade elements comprising such an insulating strip, and a method for finishing manufacturing of a roll-in head of an insulating strip for door, window or façade elements.

Insulating composite profiles for door, window or façade elements and the like are well known. Such an insulating composite profile usually comprises two profiles thermally insulated and mechanically connected by one or more insulating strips. Such an insulating strip is made of plastic material with low thermal conductivity to provide good thermal insulation of the two profiles. The insulating strip can be connected to the profiles by so-called rolling-in of roll-in heads of the insulating strip into corresponding grooves of the profiles. This roll-in technique is exemplary shown in FIGS. 1 to 3 of WO 84/03326 A1.

The shear strength of such a roll-in connection in the longitudinal direction of the composite profile is critical, especially for larger door, window or façade elements with side lengths of 1.5 m or more.

DE 36 33 932 C1 and DE 36 33 933 A1 disclose insulating strips comprising metal elements embedded in plastic bodies of the insulating strips for providing a form-fit connection with metal profiles connected to the insulating strips.

DE 29 37 454 A1 and DE 39 39 968 A1 disclose a composite profile with an insulating strip comprising a metal wire or a metal sheet embedded in a plastic body of the insulating strip for increasing shear strength between the insulating strip and the metal profiles.

EP 0 085 410 A2 discloses insulating strips comprising wires, strips or foils for increasing shear strength of composite profiles which could be made of metal having a low melting point (lower than that of the metal profiles).

EP 0 032 408 A2, EP 2 045 430 A1, CH 354 573, DE-AS 25 52 700 (family GB 1 523 676), DE-OS 28 30 798, and DE 37 42 416 A1 disclose further techniques to increase shear strength of composite profiles for door, window or façade elements.

DE 32 36 357 A1 discloses a composite profile for door, window or façade elements comprising an insulating strip with a metal layer on an end of the insulating strip. A surface of the groove facing the metal layer may comprise a knurling pattern.

SUMMARY

In one aspect of the present teachings, an improved technique for ensuring high shear strength in composite profiles for door, window or façade elements is disclosed.

A metal sheet can be disposed on a least a part of a surface of a roll-in head of an insulating strip. The shear strength with respect to the roll-in head and the metal profile is increased by surface variations like perforations and flaps provided in the metal sheet.

The strip body and the roll-in head of the insulating strip are usually formed integrally, e.g., by extrusion, but assembly from different parts is possible, too, e.g. by gluing, welding etc. The metal sheet can be mounted on the roll-in head after the extrusion because the sheet does not have to be fully embedded in the roll-in head.

A firm fit of the metal sheet on the roll-in head can be provided by surface variations of the metal sheet in form of protrusions into the surface of the roll-in head. Such protrusions can be achieved by pressing the perforations and/or the flaps into the material of the roll-in heads.

BRIEF DESCRIPTION OF THE DRAWINGS

Additional features and advantages will become apparent upon reviewing the following detailed description of exemplary embodiments with reference to the appended figures.

DETAILED DESCRIPTION OF EXEMPLARY EMBODIMENTS

Figure 1:
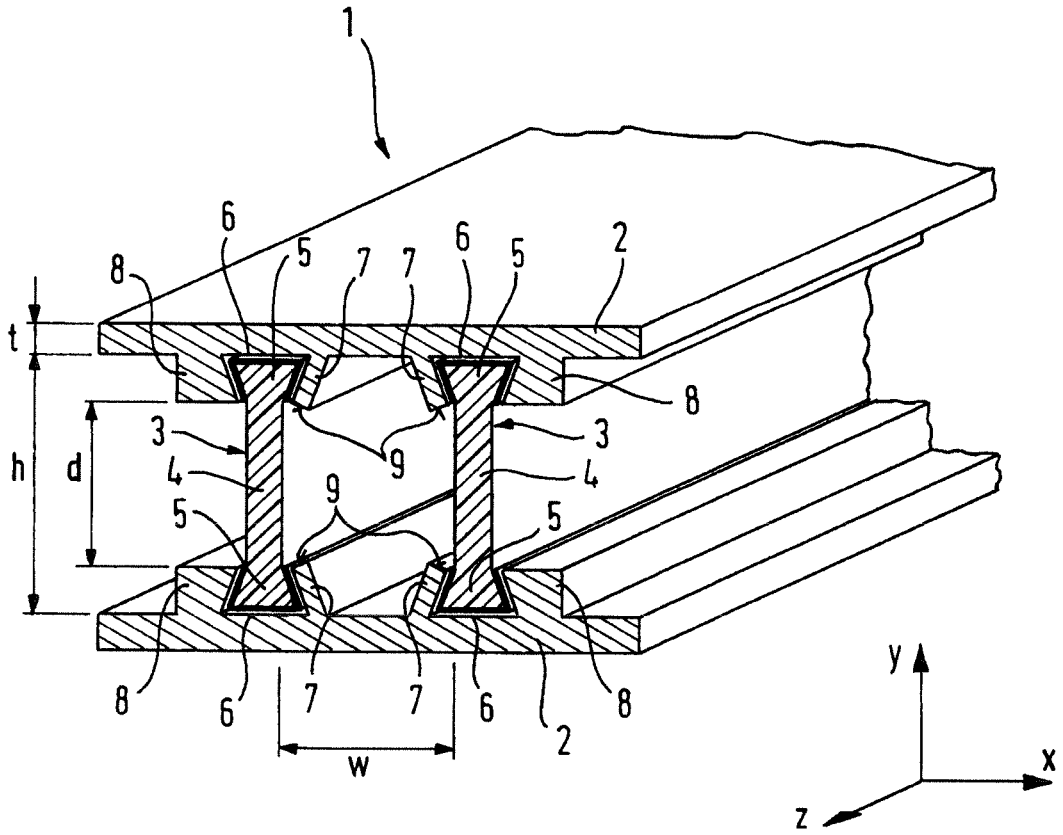
FIG. 1 shows a perspective view of a composite profile for door, window or façade elements according to one embodiment of the present teachings and also shows a cross-section in a plane perpendicular to a longitudinal direction of the composite profile.

FIG. 1 shows a partial perspective view of a composite profile 1 for door, window or façade elements according to an embodiment with a cross-section in a plane perpendicular to a longitudinal direction z. The composite profile 1 extends along the longitudinal direction z. The cross-section of the composite profile 1 along the longitudinal direction z is essentially constant.

The composite profile 1 comprises two profiles 2. The two profiles 2 are disposed opposite to each other in a height direction y, which is perpendicular to the longitudinal direction z, and are spaced apart by a distance d in the height direction y. The distance d can be in a range of 1 cm to 25 cm. A wall thickness t of the profiles 2 can be in a range from 1 mm to 20 mm.

The profiles 2 are made of a metal material such as aluminium. The metal material of the profiles 2 usually has a tensile strength in a range with a lower limit of 80 $N/mm^2$ for relatively pure aluminium and an upper limit of 600 $N/mm^2$ for high strength aluminium alloys, and a yield strength in a range with a lower limit of 30 $N/mm^2$ for relatively pure aluminium and an upper limit of 500 $N/mm^2$. A typical value for a typical aluminium alloy used for composite profiles for window, door or façade elements such as EN AW 6060, EN AW 6061, EN AW 6063 are a tensile strength of 180-260 N/mm$^2$ and a yield strength of 160-230 N/mm$^2$.

The profiles 2 are connected to each other by two insulating strips 3. The insulating strips 3 are spaced apart by a distance w in a width direction x, which is perpendicular to the height direction y and the longitudinal direction z. The distance w can be in a range of 1 cm to 20 cm. A height h of the insulating strips 3 in the height direction y corresponds essentially to the distance d between the profiles 2.

Each of the insulating strips 3 comprises a strip body 4. A thickness of the strip body 4 in a region roughly in the middle between the two profiles 2 in the height direction y is in a range, for example, from 1 mm to 10 mm. The strip body 4 is made of a plastic material with low thermal conductivity λ less than or equal to 1 W/(m K), or preferably to 0.1 W/(m K) such as PA66GF25.

Each of the insulating strips 3 comprises two roll-in heads 5. The roll-in heads 5 are formed at longitudinal edges of the strip body 4 in the height direction y. The roll-in heads 5 are formed integrally with the strip body 4 and are made of the same material as the strip body 4.

The roll-in heads 5 are dovetail-shaped in the cross-section shown in FIG. 1. The cross-sections of the roll-in heads 5 are essentially constant along the longitudinal direction z.

The cross-section of each roll-in head 5 is essentially trapezoidal. The short basis being the shorter one of the two parallel sides of the trapezoidal shape is integrally connected to the strip body 4 in the height direction y. The long basis being the longer one of the two parallel sides of the trapezoidal shape is located on the opposite side and faces the profile 2, to which the roll-in head 5 is connected, in the height direction y. The long basis is located at an outer edge of the insulating strip 3 in the height direction y. The legs of the trapezoidal shape being the lateral, non-parallel sides of the trapezoidal shape diverge in the width direction x along the height direction y from the strip body 4 towards the profile 2. The angles between the legs and the long basis are acute angles (<90°). The angles between the legs and the short basis are obtuse angles (>90°).

The dovetail-shaped cross-section of the roll-in head 5 is tapered in the height direction y from the profile 2 towards the strip body 4. In other words, the dovetail-shaped cross-section of the roll-in head 5 widens along the height direction y from the strip body 4 towards the profile 2. A thickness of the roll-in head 5 in the width direction x increases along the height direction y from the strip body 4 towards the outer edge of the insulation strip 3 facing the profile 2.

One of the two roll-in heads 5 is inserted into a groove 6 of the one of the two profiles 2 in FIG. 1, and the other one of the two roll-in heads 5 is inserted into a groove 6 of the other one of the two profiles 2 in FIG. 1. The shapes of the cross-sections of the grooves 6 are essentially complementary to the dovetail cross-sectional shapes of the corresponding roll-in heads 5.

Each of the grooves 6 is delimited by a hammer (crimpable flange) 7 and a counterpart 8. A free end 9 of the hammer 7 in the height direction y is spaced apart from the counterpart 8 in the width direction x in an unassembled state of the composite profile 1 such that the roll-in head 5 can be inserted into the groove 6. After the roll-in head 5 has been inserted into the groove 6, the free end 9 of the hammer 7 is bent (pushed) towards the roll-in head 5 and the counterpart 8 such that the free end 9 presses the roll-in head 5 against the counterpart 8 and into the groove 6, thereby crimping the roll-in head 5 between the hammer (crimpable flange) 7 and the counterpart 8. The roll-in head 5 is thus form-fit (friction-fit) in the groove 6, whereby the insulating strip 3 is connected with (engaged or held by) the profile 2. Before bending the free end 9 of the hammer 7, there is a clearance between the roll-in head 5 and the corresponding groove 6, which allows the roll-in head 5 to be inserted into the groove 6 along the longitudinal direction z.

Figure 2:
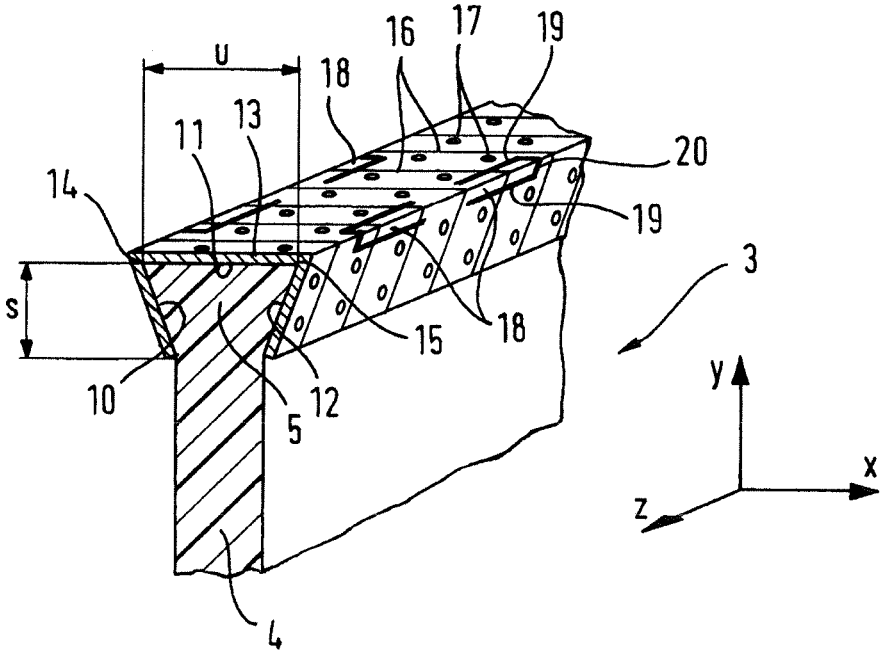
FIG. 2 shows a partial perspective view of an insulating strip for door, window or façade elements according to the embodiment of FIG. 1 and also shows a cross-section in a plane perpendicular to the longitudinal direction of the insulating strip, FIGS. 3A to 3L respectively show various perforation patterns of a metal sheet for use with the insulating strip of FIG. 2.

FIG. 2 shows a partial perspective view of a part of one of the insulating strips 3 in a region of the roll-in head 5 with a cross-section in the same plane as the cross-section shown in FIG. 1.

As shown in FIG. 2, the roll-in head 5 comprises three surfaces 10, 11, 12 on three sides of the dovetail-like shape. A first surface 11 of the three surfaces 10, 11, 12 corresponds to the long basis of the trapezoidal shape at the distal outer edge side of the dovetail-like shape of the roll-in head 5 in the height direction y. Two second surfaces 10, 12 of the three surfaces 10, 11, 12 correspond to the legs of the trapezoidal shape at the lateral sides of the dovetail-like shape of the roll-in head 5 in the width direction x. The second surfaces 10, 12 are lateral relative to the distal outer edge side of the dovetail-like shape of the roll-in head 5. The first surface 11 faces the groove 6. One of the two second surfaces 10, 12 faces the hammer 7, and the other one of the two second surfaces 10, 12 faces the counterpart 8.

A width u of the roll-in head 5 in the width direction x at the distal outer edge side of the dovetail shape is in a range of 2 mm to 10 mm. A height s of the roll-in head 5 in the height direction y is in a range from 1 mm to 10 mm.

A metal sheet 13 covers the three surfaces 10, 11, 12 of the roll-in head 5. The metal sheet 13 is made of a metal material such as steel or a high-strength aluminium alloy with a tensile strength in a range of 300 N/mm$^2$ to 2000 N/mm$^2$ or higher, and a yield strength in a range of 150 N/mm$^2$ to 1000 N/mm$^2$ or higher. In any case, the tensile strength of the metal material of the metal sheet 13 is selected to be higher than the tensile strength of the metal material of the profiles 2, and the yield strength of the metal material of the metal sheet 13 is selected to be higher than the yield strength of the metal material of the profiles 2. A thickness of the metal sheet 13 is in a range from 0.05 mm to 1 mm.

The metal sheet 13 is bent around the two transition edges 14, 15 between the first surface 11 and the second surfaces 10, 12 of the roll-in head 5. The metal sheet 13 covers the three surfaces 10, 11, 12 of the roll-in head 5. The metal sheet 13 does necessarily cover the entire second surfaces 10, 12. The metal sheet 13 may cover a part of each of the second surfaces 10, 12, which extends from the corresponding transition edge 14, 15 towards the strip body 4 over a distance in a range from 1 mm to 10 mm. The metal sheet 13 is pressed onto the roll-in head 5 and extends on the roll-in head 5 along the longitudinal direction z.

An outer surface of the metal sheet 13 facing away from the roll-in head 5 is in contact with surfaces of the groove 6, the hammer 7, and the counterpart 8, respectively, when the roll-in head 5 in mounted in the groove 6 in a rolled-in state. The outer surface of the metal sheet 13 is pressed onto the surfaces of the groove 6, the hammer 7, and the counterpart 8, respectively, due to the pressure of the hammer 7 onto the roll-in head 5 and the metal sheet 13.

The outer surface of the metal sheet 13 comprises a knurling pattern 16. A depth of grooves of the knurling pattern 16 is in a range from 0.01 mm to 2.0 mm, preferably 0.01 mm to 1.0 mm or 0.05 mm to 2.0 mm or 0.1 mm to 0.7 mm or 0.2 mm to 0.5 mm or 0.5 mm to 2.0 mm or 1.0 mm to 2.0 mm. The grooves of the knurling pattern 16 extend essentially perpendicular to the longitudinal direction z along the outer surface of the metal sheet 13. The grooves of the knurling pattern 16 have a width in the longitudinal direction in a range from 0.1 mm to 10 mm. The knurling pattern 16 can be formed on the outer surface of the metal sheet 13 before the metal sheet 13 is disposed on the roll-in head 5. The knurling pattern 16 can be formed by using a knurling wheel. Preferably, peaks of the knurling wheel are sharp. Preferably, a width of the peaks of the knurling wheel in a circumferential direction is in a range from 0.1 mm to 0.5 mm, or in a range from 0.1 mm to 0.2 mm. The knurling pattern 16 enhances shear strength between the outer surface of the metal sheet 13 and the surfaces of the groove 6, the hammer 7, and the counterpart 8, respectively, that are in contact with the metal sheet 13.

The metal sheet 13 comprises holes 17 formed by clinching and/or perforation. The holes 17 are formed after disposing the metal sheet 13 on the roll-in head 5. The holes 17 penetrate the metal sheet 13. The holes 17 are essentially circular.

The holes 17 can be formed using a perforation cutter. A width of peaks of the perforation cutter in a direction perpendicular to a cutting direction can be in a range from 0.05 mm to 10 mm, or in a range from 0.1 mm to 1.0 mm. A penetration depth of peaks of the perforation cutter into the metal sheet 13 and the surface of the roll-in head 5 can be in a range with a lower limit of 0.05 mm, 0.1 mm, 0.2 mm, 0.3 mm, 0.4 mm, 0.5 mm, 0.6 mm, 0.7 mm, 0.8 mm, 0.9 mm, or 1.0 mm and an upper limit of 2 mm or more.

Figure 4:
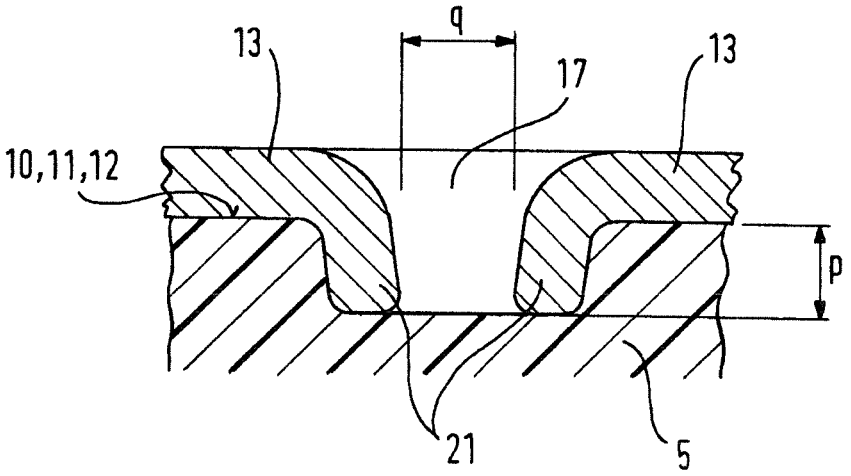
FIG. 4 shows a partial cross-sectional view of a region at a surface of the roll-in head of the insulating strip of the embodiment around a perforation hole in the metal sheet in a plane perpendicular to the surface of the roll-in head, and FIGS. 5A to 5H respectively show partial views of various embodiments of insulating strips with different roll-in heads.

FIG. 4 shows a cross-section of a region at the surface 10, 11, 12 of the roll-in head 5 covered by the metal sheet 13 around a hole 17 in a plane perpendicular to the surface 10, 11, 12 of the roll-in head 5. A diameter q of the hole 17 is in a range from 0.2 mm to 2 mm, preferably 0.2 mm to 0.5 mm, e.g., 0.3 mm or 0.4 mm. A rim 21 of the hole 17 protrudes into the plastic material of the roll-in head 5. A protrusion depth p of the rim 21 of the hole 17 into the plastic material is in a range with a lower limit of 0.05 mm, 0.1 mm, 0.2 mm, 0.3 mm, 0.4 mm, 0.5 mm, 0.6 mm, 0.7 mm, 0.8 mm, 0.9 mm, or 1.0 mm and an upper limit of 1 mm, 2 mm, or more. The rim 21 of the hole 17 protruding into the plastic material of the roll-in head 5 provides a form-fit (friction-fit) connection between the metal sheet 13 and the roll-in head 5 in a plane parallel to the corresponding surface 10, 11, 12 of the roll-in head 5.

The metal sheet 13 comprises flaps 18 formed along the transition edges 14, 15 of the roll-in head 5 in the longitudinal direction z. Each flap 18 comprises two parallel longitudinal cutting edges 19 extending along the longitudinal direction z and one transverse cutting edge 20 perpendicular to the longitudinal cutting edges 19. The term "parallel" in this context covers a parallel arrangement and allows variations of to 20°, 5°, 1°, or 0.1° of an angle between the two longitudinal cutting edges 19. The term "perpendicular" in this context covers a perpendicular arrangement and allows variations of up to 20°, 5°, 1°, or 0.1° of an angle between the transverse cutting edge 20 and each of the longitudinal cutting edges 19 One of the longitudinal cutting edges 19 of each of the flaps 18 formed along each of the transition edges 14, 15 is formed in a part of the metal sheet 13 covering the corresponding one of the second surfaces 10, 12 adjacent to the corresponding transition edge 14, 15. The other one of the longitudinal cutting edges 19 is formed in a part of the metal sheet 13 covering the first surface 11. The transverse cutting edge 20 extends along the metal sheet 13 across the corresponding one of the transition edges 14, 15. The transverse cutting edge 20 is connected to ends of the longitudinal cutting edges 19 of the flap 18 on one side or the other side in the longitudinal direction z. A length of the transverse cutting edge 20 is in a range from 1 mm to 10 mm. A length of each of the longitudinal cutting edges 19 is in a range from 1 mm to 10 mm. A distance between flaps 18 adjacent along each of transition edges 14, 15 in the longitudinal direction z is in a range from 5 mm to 30 mm.

The side of each flap 18 in the longitudinal direction z, on which the transverse cutting edge 20 is connected to the longitudinal cutting edges 19, alternates for any two flaps 18 adjacent in the longitudinal direction z along each of the transition edges 14, 15. Any two adjacent flaps 18 along one of the transition edges 14, 15 are symmetric to each other. The transverse cutting edges 20 are disposed on two sides of the two adjacent flaps 18 in the longitudinal direction z that either face each other or are opposite to each other.

The flaps 18 are pressed into the plastic material of the of the roll-in head 5 along the transition edges 14, 15 on the sides of the flaps, on which the transverse cutting edges 20 are connected to the longitudinal cutting edges 19, after disposing the metal sheet 13 on the roll-in head 5. The transverse cutting edges 20 of the flaps 18 pressed into the plastic material of the roll-in head 5 provide form-fit and high shear strength between the metal sheet 13 and the roll-in head 5. A protrusion depth of the transverse cutting edges 20 into the plastic material can be in the same range as the protrusion depth p of the holes 17. High shear strength in both directions along the longitudinal direction z is provided because the transverse cutting edges 20 are formed on alternating sides of the flaps 18 in the longitudinal direction z, i.e., alternating sides of the flaps 18 are pressed into the plastic material of the roll-in head 5.

Each part of the metal sheet 13 covering one of the surfaces 10, 11, 12 of the roll-in head 5 comprises two lines of holes 17 extending in the longitudinal direction z.

Each of FIGS. 3A to 3L shows a plan view of a part of a metal sheet 13 extending in the longitudinal direction z that covers one of the surfaces 10, 11, 12 of the roll-in head 5, i.e., each of FIGS. 3A to 3L shows one of three parts of a metal sheet 13. The holes 17 are arranged in different patterns in the parts of the metal sheets 13. The distances between neighbouring holes 17 are in a range from 1 mm to 20 mm or in a range from 2 mm to 10 mm.

Figure 3A:
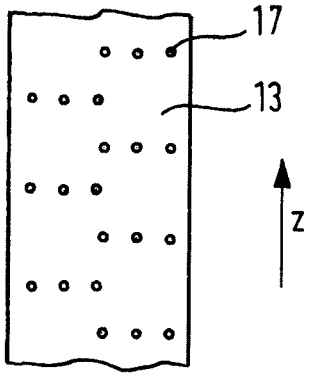

FIG. 3A shows a part of a metal sheet 13 with groups of three circular holes 17 disposed alternatingly on two sides of the part of the metal sheet 13 in a direction perpendicular to the longitudinal direction z and parallel to a surface of the part of the metal sheet 13 (on the left side and the right side in the figure). The holes 17 in each group are arranged linearly in the direction perpendicular to the longitudinal direction z. The innermost hole 17 on the center side of each group is disposed roughly in the middle between two edges of the part of the metal sheet 13 in the direction perpendicular to the longitudinal direction z. The pattern can be formed by two cutting tools, each having three cutters.

Figure 3B:
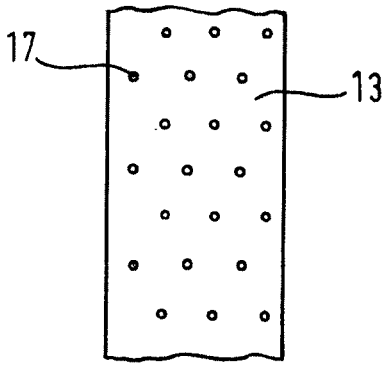

FIG. 3B shows a part of a metal sheet 13 that is similar to the part of the metal sheet 13 shown in FIG. 3A. The distances between the individual holes 17 in each group in the direction perpendicular to the longitudinal direction z is larger than in the part of the metal sheet 13 shown in FIG. 3A. The pattern can be formed by one cutting tool having six cutters.

Figure 3C:
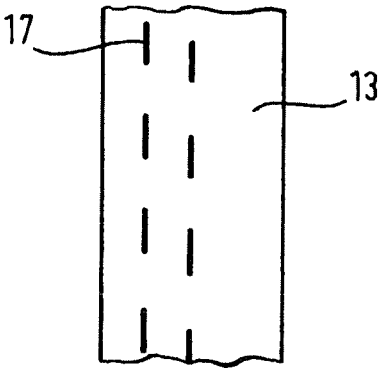

FIG. 3C shows a part of a metal sheet 13 with elongated slit-like holes 17. Each of the holes 17 has a length in a range from 1 mm to 10 mm along the longitudinal direction z. Each of the holes 17 has a width in a range from 0.2 mm to 2 mm in a direction perpendicular to the longitudinal direction z. The holes 17 are arranged in two lines, each extending along the longitudinal direction z. One of the two lines is located roughly in the middle between the two edges of the part of the metal sheet 13 in the direction perpendicular to the longitudinal direction z. The other one is located roughly in the middle between the one line and the left edge of the part of the metal sheet 13 in the direction perpendicular to the longitudinal direction z.

Figure 3D:
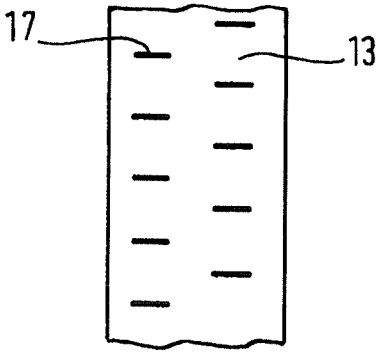

FIG. 3D shows a part of a metal sheet 13 with elongated slit-like holes 17. Each of the holes 17 has a length in a range from 1 mm to 10 mm perpendicular to the longitudinal direction z. The holes 17 are arranged in two lines along the edges of the part of the metal sheet 13 in the direction perpendicular to the longitudinal direction z. The holes 17 are arranged alternatingly in the two lines. There is only one hole 17 at each position along the longitudinal direction z in either one of two lines.

Figure 3E:
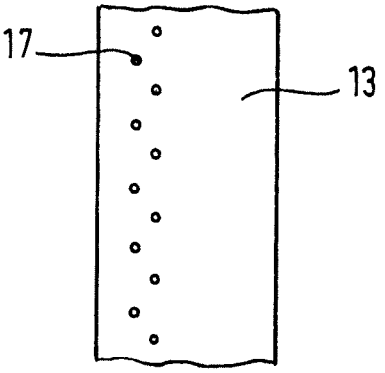

FIG. 3E shows a part of a metal sheet 13 that corresponds to the part of the metal sheet 13 shown in FIG. 3C except for the fact that circular holes 17 are used instead of the elongated holes 17.

Figure 3F:
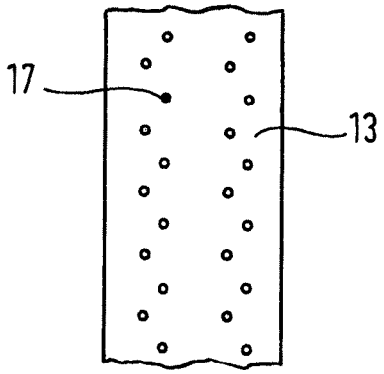

FIG. 3F shows a part of a metal sheet 13 that corresponds to the part of the metal sheet 13 shown in FIG. 3E except for the fact that the part of the metal sheet 13 comprises four lines of circular holes 17 extending along the longitudinal direction z. There are two lines on each side of the part of the metal sheet 13 in the direction perpendicular to the longitudinal direction z. The holes 17 are arranged alternatingly in the two lines on each side along the longitudinal direction z.

Figure 3G:
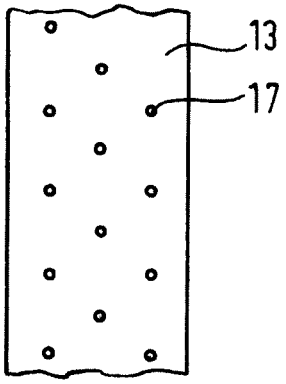

FIG. 3G shows a part of a metal sheet 13 with groups of three circular holes 17. The holes 17 of each group are arranged in a diagonal line between the two edges of the part of the metal sheet 13 in the direction perpendicular to the longitudinal direction z.

Figure 3H:
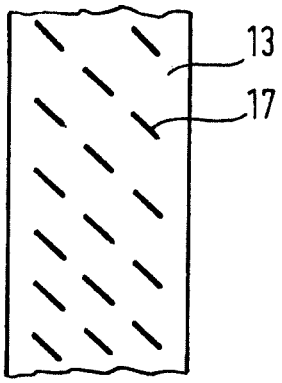

FIG. 3H shows a part of a metal sheet 13 that corresponds to the part of the metal sheet 13 shown in FIG. 3G except for the fact that elongated slit-like holes 17 are used instead of the circular holes 17 shown in FIG. 3G.

Figure 3I:
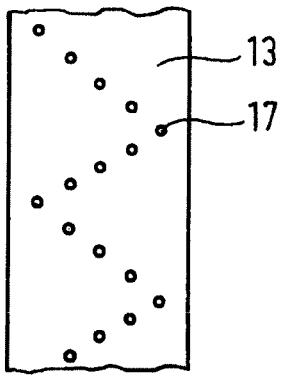

FIG. 3I shows a part of a metal sheet 13 with circular holes 17 arranged in a zigzag line between the edges of the part of the metal sheet 13 along the longitudinal direction z. Each leg of the zigzag line extends roughly diagonally across the part of the metal sheet 13.

Figure 3J:
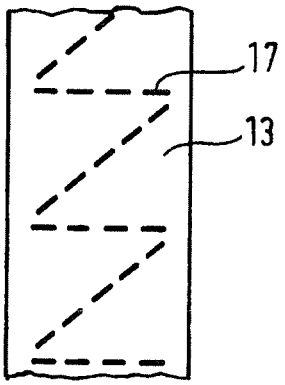

FIG. 3J shows a part of a metal sheet 13 with elongated slit-like holes 17 arranged in a zigzag line between the edges of the part of the metal sheet 13 along the longitudinal direction z. The legs of the zigzag line alternatingly extend perpendicular to the longitudinal direction z and roughly diagonally, respectively, across the part of the metal sheet 13.

Figure 3K:
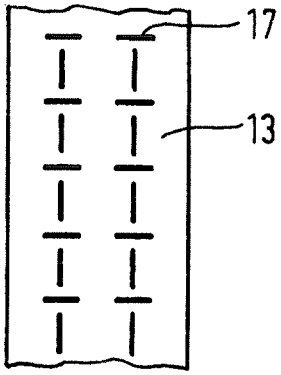

FIG. 3K shows a part of metal sheet 13 with elongated slit-like holes 17 arranged in two lines extending along the longitudinal direction z. The elongated slit-like holes 17 in each line alternatingly extend along the longitudinal direction z and perpendicular to the longitudinal direction z.

Figure 3L:
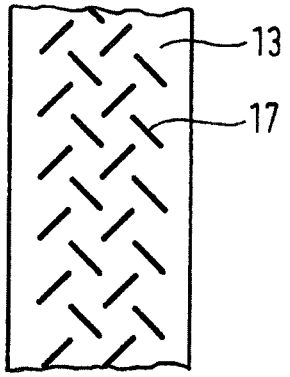

FIG. 3L shows a part of a metal sheet 13 with elongated slit-like holes 17 arranged in diagonal lines across the part of the metal sheet 13. The direction of extension of the elongated slit-like holes 17 in each line alternates between two diagonal directions that are perpendicular to each other.

The holes 17 do not have to be arranged in the above patterns but can be arranged in different patterns or can be arranged randomly. Each of the parts of the metal sheet 13 covering one of the surfaces 10, 11, 12 of the roll-in head 5 may comprise the same pattern of holes 17 or may comprise a different pattern.

Not all parts of the metal sheet 13 covering one of the surfaces 10, 11, 12 must comprise the holes 17. Only one or only two of the parts may comprise the holes 17. The metal sheet 13 may comprise the flaps 18 but not the holes 17. The metal sheet 13 may comprise the holes 17 but not the flaps 18.

The flaps 18 do not necessarily have to be disposed along the transition edges 14, 15. Each of the parts of the metal sheet 13 covering one of the surfaces 10, 11, 12 of the roll-in head 5 may comprise flaps 18.

The outer surface of the metal sheet 13 facing away from the roll-in head 5 does not necessarily comprise the knurling pattern 16. The inner surface of the metal sheet 13 facing the roll-in head 5, which is in contact with the surfaces 10, 11, 12 of the roll-in head 5, may comprise a knurling pattern. The grooves of the knurling pattern on the inner surface and/or the outer surface of the metal sheet 13 can extend obliquely with respect to the longitudinal direction z.

Figure 5A:
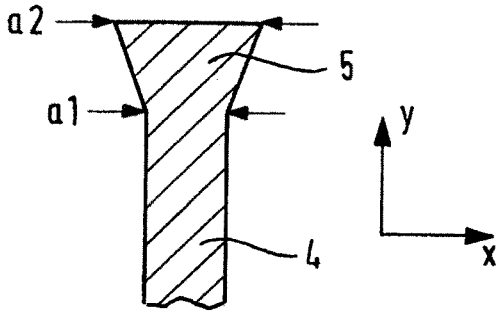

FIG. 5A shows a partial cross-sectional view of one of the roll-in heads 5 of one of the insulating strips 3 in the plane x-y perpendicular to the longitudinal direction z, as in FIGS. 1 and 2.

As described above, the dovetail-shaped cross-section of the roll-in head 5 widens along the height direction y from the strip body 4 towards the profile 2. A (first) thickness a2 of the roll-in head 5 at a distal outer edge of the insulating strip 3 facing the profile 2 is larger than a (second) thickness a1 of the roll-in head 5 at the transition from the roll-in head 5 to the strip body 4. The thickness a2 of the roll-in head 5 at the distal outer edge can be in a range with a lower limit of 1.2 times the thickness a1 of the roll-in head 5 at the transition from the roll-in head 5 to the strip body 4, 1.5 times the thickness a1 of the roll-in head 5 at the transition from the roll-in head 5 to the strip body 4, or 1.8 times the thickness a1 of the roll-in head 5 at the transition from the roll-in head 5 to the strip body 4 and an upper limit of 2 times the thickness a1 of the roll-in head 5 at the transition from the roll-in head 5 to the strip body 4 or 4 times the thickness a1 of the roll-in head 5 at the transition from the roll-in head 5 to the strip body 4.

The bases and/or the legs of the essentially trapezoidal cross-section of the roll-in head 5 can be straight lines or can be curved or recessed or the like. The bases and/or the legs can, e.g., include one or more recesses and/or notches.

The cross-sectional shape of the roll-in head 5 can be different from the shape shown in FIGS. 1, 2, and 5A as long as the cross-sectional shape of the roll-in head comprises the (first) thickness a2 between the transition from the roll-in head to the strip body 4 and the distal outer edge being larger than the (second) thickness a1 of the roll-in head at the transition from the roll-in head to the strip body 4. The (first) thickness a2 can be located at the distal outer edge of the roll-in head or can be located somewhere in between the transition from the roll-in head to the strip body 4 and the distal outer edge of the roll-in head in the height direction y. FIGS. 5B to 5H show examples of alternative cross-sectional shapes of roll-in heads, in which the (first) thickness a2 is located at the distal outer edge of the roll-in head, i.e., the cross-sectional shape of the roll-in head is wider at the distal outer edge than at the transition from the roll-in head to the strip body 4. The (first) thickness a2 at the distal outer edge of the roll-in head can be the maximum thickness of the roll-in head. Alternatively, the (first) thickness a2 can be located between the transition from the roll-in head to the strip body and the distal outer edge of the roll-in head in the height direction y. In this case, the (first) thickness a2 can be located closer to the distal outer edge of the roll-in head than to the transition from the roll-in head to the strip body in the height direction y.

Figure 5B:
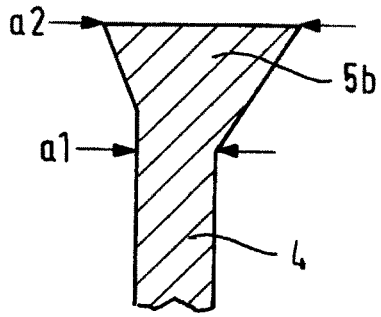

FIG. 5B shows a cross-sectional shape of a roll-in head 5*b* which is a modification of the dovetail cross-sectional shape shown in FIG. 5A. The roll-in head 5*b* comprises an asymmetric cross-sectional shape with a long basis at the distal outer edge of the roll-in head 5*b* and two legs. The two legs have different lengths. A protrusion length of the long basis in the width direction x with respect to the strip body 4 is larger on one side of the roll-in head 5*b* in the width direction x than on the other side. The protrusion length on the one side can be in a range of 1.2 to 4 times the protrusion length on the other side. A first distance in the height direction y from a starting point of the leg on one side of the roll-in head 5*b* in the width direction x, i.e. a point where the leg is angled from the essentially straight surface of the strip body 4, to the long basis can be equal to or can be larger than a second distance in the height direction y from a starting point of the leg on the other side to the long basis. The first distance can be in a range of 1 to 4 times the second distance. A transition from the roll-in head 5*b* to the strip body 4 is defined by the starting point of the leg on the side of the roll-in head 5*b* which is further away from the long basis. The angles between the two legs and the long basis can be the same or can be different from each other.

Figure 5C:
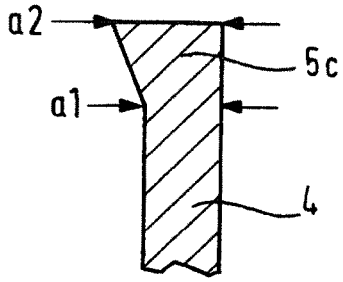

FIG. 5C shows a cross-sectional shape of a roll-in head 5*c* which is a modification of the trapezoidal cross-sectional shape shown in FIG. 5A. Different from the cross-sectional shape shown in FIG. 5A, the angle between one of the two legs of the trapezoidal cross-sectional shape of the roll-in head 5*c* and the long basis and the angle between the one of the two legs and the short basis are rectangular (≈90°).

Figure 5D:
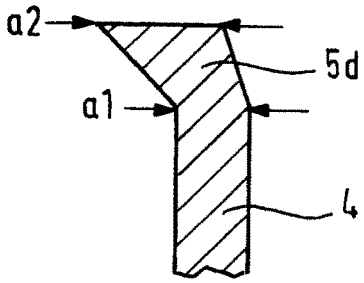

FIG. 5D shows a cross-sectional shape of a roll-in head 5*d* which is another modification of the trapezoidal cross-sectional shape shown in FIG. 5A. Different from the cross-sectional shape shown in FIG. 5A, the angle between one of the two legs of the trapezoidal cross-sectional shape of the roll-in head 5*d* and the long basis is an obtuse angle (>90°), and the angle between the one of the two legs and the short basis is an acute angle (<90°).

Figure 5E:
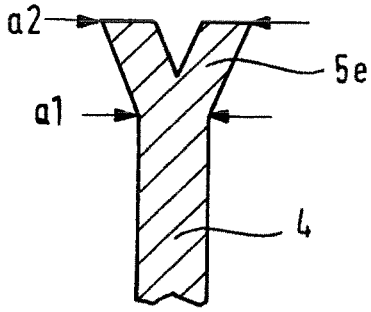

FIG. 5E shows a cross-sectional shape of a roll-in head 5*e* which is another modification of the trapezoidal cross-sectional shape shown in FIG. 5A. Different from the cross-sectional shape shown in FIG. 5A, the long basis of the trapezoidal shape of the roll-in head 5*e* comprises a notch. A depth of the notch in the height direction y can be up to 0.8 times the height of the roll-in head 5*e* in the height direction y. The cross-sectional shape of the notch shown in FIG. 5E is triangular. However, the notch can have a different cross-sectional shape.

Figure 5F:
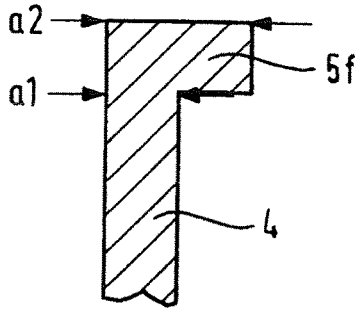

FIG. 5F shows a stepped cross-sectional shape of a roll-in head 5*f* comprising a rectangular shape. The rectangular shape protrudes in the width direction x with respect to the strip body 4 on one side of the strip body 4. The thickness a1 of the roll-in head 5*f* at the transition from the roll-in head 5*f* to the strip body 4 corresponds to the thickness of the strip body 4.

Figure 5G:
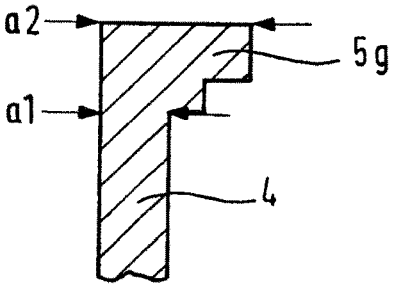

FIG. 5G shows a cross-sectional shape of a roll-in head 5*g* which is a modification of the stepped roll-in head 5*f* shown in FIG. 5F. The cross-sectional shape of the roll-in head 5*g* comprises another step at the corner of the rectangular shape that protrudes from the strip body 4 in the width direction x.

Figure 5H:
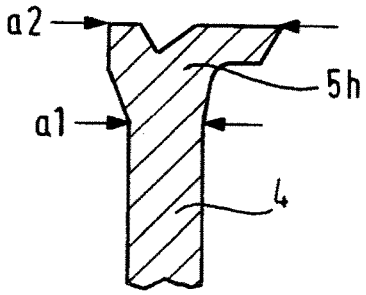

FIG. 5H shows an irregular cross-sectional shape of a roll-in head 5*h*. The cross-sectional shape of the roll-in head 5*h* is asymmetric and comprises a notch at the distal outer edge of the roll-in head 5*h* facing the profile 2.

Although not shown in FIGS. 5A to 5H, the metal sheet 13 is provided on at least a part of a surface of each of the roll-in heads 5, 5*b*, 5*c*, 5*d*, 5*e*, 5*f*, 5*g*, 5*h*. The metal sheet 13 can be provided, e.g., on the long basis and/or one or both of the legs.

The corners of the cross-sectional shapes of the roll-in heads can be rounded.

The metal material of the profiles 2 has a lower tensile strength than the metal material of the metal sheet 13. Therefore, surfaces of the groove 6, the hammer 7, and/or the counterpart 8, respectively, can be deformed by the pressure of the hammer 7 onto the roll-in head 5 and the metal sheet 30, when the roll-in head 5 is rolled in in the groove 6, thereby increasing shear strength. The metal material of the profiles 2 can flow into the knurling pattern 16, the holes 17 and/or the flaps 18 thereby increasing shear strength.

A flux of material in horizontal and/or vertical direction can be controlled depending on the way of perforating and/or clinching the metal sheet 13.

A shear strength of the thermally insulating composite profile 1 of equal to or larger than 70 N/mm can be achieved with the insulating strips 3.

The present disclosure is not limited to the embodiments described above. Features of the different embodiments can be combined and further modification can be applied.

The metal material of the metal sheet 13 can be selected from a group comprising stainless steel, zinc plated steel, aluminium alloys such as AW 7068 or AW7075, and other metals or alloys. Introducing the roll-in head 5 into the groove 6 is facilitated if the metal material of the metal sheet 13 does not comprise aluminium. The tensile strength of the metal material of the metal sheet can be higher than 500 $N/mm^2$ or can be higher than 700 $N/mm^2$.

The insulating strips 3 can be made of plastic material such as PA, PBT, PA-PBE, PET, PMI, PVC, Polyketone, PP, or PUR. The insulating strips 3 can be made of thermoplastic material.

The insulating strips 3 can comprise reinforcing elements such as glass fibers and/or can be made of bio polymers, which are based on renewable resources. Examples for polymers, which can be based on renewable resources, are PA 5.5, PA 5.10, PA 6.10, PA 6.6, PA 4.10, PA 10.10, PA 11, PA 10.12.

The insulating strips 3 can comprise foamed, cellular, and/or porous plastic material. The material of the insulating strips 3 can be completely or partly foamed. The material of the strip body 4 can be completely or partly foamed. The strip body 4 can comprise a foamed core surrounded by a layer of non-foamed material. The material of the roll-in heads 5 can be foamed or not. The roll-in head 5 can be formed integrally with the strip body 4 or can be formed separately and joined to the strip body 4, e.g., by an adhesive. If the roll-in head 5 and the strip body 4 are formed integrally, they can comprise a common core of foamed material surrounded by a cover on non-foamed material. An insulating strip comprising a core of fine pored, closed-cell plastic material and a surface layer of compact, non-porous plastic material as shown in FIG. 1 of EP 1 242 709 B2 can be used.

The roll-in heads 5 can be made of a different plastic material than the strip body 4.

The cross-sectional shapes of the roll-in heads 5 are constant along the longitudinal direction z except for the recesses caused by and/or receiving the surface variations of the metal sheet 13.

The material of the sheet 13 can have a melting point or melting temperature which is higher than a maximum temperature during a coating or varnishing treatment of the insulating strip 3. The melting point of the material of the sheet 13 may be 400 K, 500 K, 550 K, 600 K, 750 K, 1000 K or higher.

The melting point of the material of the sheet 13 can be at least 50 K (Kelvin), 100 K, 150 K, 200 K, 250 K, 300 K, 500 K or 1000 K higher than a melting point of the plastic material of the insulating strip 3. The melting point of the plastic material of the insulating strip 3 can be, e.g., 533 K for PA 6.6 or 513 K for PA 6.10 or 471 K for PA 11. Further values of melting points of plastic materials can be obtained from literature.

The metal sheet 13 can be joined to the roll-in head 5 by laser welding of the metal sheet 13 to metal elements embedded in the roll-in head 5.

The flaps 18 can be cut into the metal sheet 13 using a laser or a cutting wheel. The flaps 18 can be cut into the metal sheet 13 before or after disposing the metal sheet 13 on the roll-in head 5. Other insulating strips may be used instead of the insulating strips 3 shown in the above embodiments. An insulating strip may comprise more than two roll-in heads 5 and/or may be wider in the width direction x than each of the insulating strips 3 shown in the above embodiments. The profiles 2 may be connected by only one insulating strip.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

Aspects

1. Insulating strip (3) for connecting profiles (2, 2) of a composite profile (1) for doors, windows or façade elements, at least one of the profiles (2, 2) being made of a metal material with a first tensile strength and/or a first yield strength and having at least one roll-in groove (6) for roll-in connection with the insulating strip (3), comprising
a strip body (4) made of an insulating material and extending in a longitudinal direction (z), a roll-in head (5) at a longitudinal edge of the strip body (4), the roll-in head (5) having a cross-sectional shape in a plane (x-y) perpendicular to the longitudinal direction (z) adapted to be inserted into the at least one roll-in groove (6) and having a first thickness (a2) of the cross-sectional shape of the roll-in head (5) towards a distal outer edge of the roll-in head (5) facing the at least one roll-in groove (6) being larger than a second thickness (a1) of the cross-sectional shape of the roll-in head (5) at a transition from the roll-in head (5) to the strip body (4), and a sheet (13) covering at least a part of a surface (10, 11, 12) of the roll-in head (5) and comprising surface variations (16; 17; 18), wherein
the sheet (13) is made of or comprises portions made of a metal material with a second tensile strength and/or a second yield strength higher than the first tensile strength and/or the second yield strength, respectively.

2. Insulating strip (3) for connecting profiles (2, 2) of a composite profile (1) for doors, windows or façade elements, at least one of the profiles (2, 2) being made of an aluminium material having at least one roll-in groove (6) for roll-in connection with the insulating strip (3), comprising
a strip body (4) made of an insulating material and extending in a longitudinal direction (z), a roll-in head (5) at a longitudinal edge of the strip body (4), the roll-in head (5) having a cross-sectional shape in a plane (x-y) perpendicular to the longitudinal direction (z) adapted to be inserted into the at least one roll-in groove (6) and having a first thickness (a2) of the cross-sectional shape of the roll-in head (5) towards a distal outer edge of the roll-in head (5) facing the at least one roll-in groove (6) being larger than a second thickness (a1) of the cross-sectional shape of the roll-in head (5) at a transition from the roll-in head (5) to the strip body (4), and a sheet (13) covering at least a part of a surface (10, 11, 12) of the roll-in head (5) and comprising surface variations (16; 17; 18), wherein
the sheet (13) is made of or comprises portions made of steel.

3. Insulating strip according to aspect 1 or 2, wherein a surface of the sheet (13) facing away from the roll-in head (5) comprises a knurling pattern (16).

4. Insulating strip according to any of the preceding aspects, wherein the strip body (4) is made of a thermoplastic insulating material.

The invention claimed is:

1. A composite profile for doors, windows, or façade elements, the composite profile comprising:
a first profile,
a second profile, and
at least one insulating strip,
wherein:
the first profile and/or the second profile is made of a metal material having a first tensile strength and has at least one roll-in groove, the roll-in groove having an opening having a width in a plane (x-y) perpendicular to a longitudinal direction (z),
the insulating strip comprises:
a strip body made of an insulating material and extending in the longitudinal direction (z),
a roll-in head at a longitudinal edge of the strip body, the roll-in head having a cross-sectional shape in the plane (x-y) perpendicular to the longitudinal direction (z) that is inserted into the at least one roll-in groove, a first thickness (a2) of the cross-sectional shape of the roll-in head towards a distal outer edge of the roll-in head that faces the at least one roll-in groove being larger than a second thickness (a1) of the cross-sectional shape of the roll-in head at a transition from the roll-in head to the strip body and a maximum thickness of the roll-in head in the plane (x-y) perpendicular to the longitudinal direction (z) being greater than the width of the opening of the roll-in groove, and
a sheet covering at least a portion of an external surface of the roll-in head and comprising surface variations,
the sheet at least partially comprises one or more portions made of a metal material having a second tensile strength of 300 $N/mm^2$ or more, and
the second tensile strength is greater than the first tensile strength.

2. The composite profile according to claim 1, wherein the metal material of the sheet has a melting temperature that is at least 50 K higher than a melting temperature of the insulating material of the strip body.

3. The composite profile according to claim 1, wherein the sheet is formed from or comprises steel.

4. The composite profile according to claim 1, wherein the surface variations are one or more variations selected from the group consisting of: perforations, flaps, protrusions or knurls.

5. The composite profile according to claim 1, wherein the sheet covers at least part of a distal outer surface of the roll-in head.

6. The composite profile according to claim 1, wherein:

the roll-in head includes a first side surface and a second side surface, each extending from a distal outer surface of the roll-in head to the strip body and the sheet covers at least part of the first side surface.

7. The composite profile according to claim 6, wherein:

the roll-in head includes a transition edge between the distal outer surface and the first side surface and the sheet extends from the first side surface over the transition edge to the distal outer surface.

8. The composite profile according to claim 7, wherein the sheet includes flaps in a region overlying the transition edge.

9. The composite profile according to claim 8, wherein each of the flaps is delimited by two parallel longitudinal cutting edges and a transverse cutting edge perpendicular to the longitudinal cutting edges and a hinge at an end of the flap longitudinally opposite from the transverse cutting edge, each flap having an orientation from the hinge to the transverse cutting edge, and wherein the orientations of adjacent flaps alternate.

10. The composite profile according to claim 1, wherein the surface variations comprise perforations and/or flaps that protrude into the surface of the roll-in head to a depth of 0.2 mm to 2 mm.

11. The composite profile according to claim 1, wherein a portion of the roll-in head having the first thickness faces into the roll-in groove.

12. The composite profile according to claim 1, wherein the strip body is made from a thermoplastic insulating material.

13. The composite profile according to claim 12, wherein the thermoplastic insulating material has a thermal conductivity $\lambda$ less than or equal to 1 W/(m K).

14. The composite profile according to claim 13, wherein the metal material of the sheet has a melting temperature that is at least 50 K higher than a melting temperature of the insulating material of the strip body.

15. The composite profile according to claim 14, wherein the second tensile strength is 500 N/mm$^2$ or more.

16. The composite profile according to claim 15, wherein the sheet is formed from or comprises steel.

17. The composite profile according to claim 16, wherein the sheet covers at least part of a distal outer surface of the roll-in head.

18. The composite profile according to claim 17, wherein:

the roll-in head includes a first side surface and a second side surface each extending from a distal outer surface of the roll-in head to the strip body and the sheet covers at least part of the first side surface.

19. The composite profile according to claim 18, the surface variations comprise perforations and/or flaps that protrude into the surface of the roll-in head to a depth of 0.2 mm to 2 mm.

20. A method for manufacturing a composite profile for doors, windows, or facade elements, the composite profile comprising a first profile having a first tensile strength of less than 300 N/mm$^2$ and a first roll-in groove extending in a longitudinal direction (z) and a second profile having a second roll-in groove extending in the longitudinal direction (z), the method comprising:

providing an insulating strip having a strip body made of an insulating material and extending in the longitudinal direction (z), the insulating strip further including a first roll-in head at a first longitudinal edge of the strip body and a second roll-in head at a second longitudinal edge of the strip body, each of the roll-in heads having a cross-sectional shape in a plane (x-y) perpendicular to the longitudinal direction (z), a first thickness (a2) of the cross-sectional shape towards a distal outer edge of each roll-in head being larger than a second thickness (a1) of the cross-sectional shape of each roll-in head at a transition from the roll-in head to the strip body, providing a first sheet and a second sheet each made of or comprising a metal material with a second tensile strength of 300 N/mm$^2$ or more, knurling at least one surface of the first sheet and at least one surface of the second sheet, bending the first sheet around the first roll-in head with the knurled surface of the first sheet facing away from the first roll-in head so that the first sheet covers at least three sides of the first roll-in head, bending the second sheet around the second roll-in head with the knurled surface of the second sheet facing away from the second roll-in head so that the second sheet covers at least three sides of the second roll-in head, pressing protrusions on the first sheet into the first roll-in head and pressing protrusions on the second sheet into the second roll-in head, sliding the first roll-in head covered by the first sheet into the first roll-in groove, sliding the second roll-in head covered by the second sheet into the second roll-in groove, deforming a wall of the first roll-in groove to secure the first roll-in head in the first groove, and deforming a wall of the second roll-in groove to secure the second roll-in head to the second roll-in groove.

21. A method for finishing manufacturing of a roll-in head of an insulating strip for connecting profiles of a composite profile for doors, windows or façade elements, at least one of the profiles being made of a metal material having a first tensile strength of less than 300 N/mm$^2$ and having at least one roll-in groove for roll-in connection with the insulating strip, the insulating strip comprising a strip body made of an insulating material and extending in a longitudinal direction (z), and a roll-in head at a longitudinal edge of the strip body, the roll-in head having a cross-sectional shape in a plane (x-y) perpendicular to the longitudinal direction (z) configured to be inserted into the at least one roll-in groove, a first thickness (a2) of the cross-sectional shape of the roll-in head towards a distal outer edge of the roll-in head facing the at least one roll-in groove being larger than a second thickness (a1) of the cross-sectional shape of the roll-in head at a transition from the roll-in head to the strip body, the method comprising:

providing a sheet made of or at least comprising a metal material that has a second tensile strength of 300 N/mm$^2$ or more, knurling a surface of the sheet on at least one of its sides, disposing the sheet on the roll-in head such that the knurled surface of the sheet faces away from the roll-in head and such that a first portion of the sheet overlies a first surface of the roll-in head, bending the sheet along a transitional edge of the roll-in head such that a second portion of the sheet overlies the transitional edge and a second surface of the roll-in head, and pressing the sheet onto the roll-in head.

22. The method according to claim 21, including cutting flaps into the sheet before or after disposing the sheet on the surface of the roll-in head and pressing the flaps into the roll-in head.

23. The method according to claim 21, including perforating the sheet after disposing the sheet on the surface of the roll-in head.

24. The composite profile according to claim 1, wherein the sheet has a thickness of 0.05 to 1.0 mm.

25. The method according to claim 21, wherein the sheet has a thickness of 0.05 to 1.0 mm.

26. The method according to claim 20, wherein the first sheet has a thickness of 0.05 to 1.0 mm.

* * * * *